US007845496B2

(12) United States Patent
Hession

(10) Patent No.: US 7,845,496 B2
(45) Date of Patent: Dec. 7, 2010

(54) PACKAGING SYSTEM WITH AN IMPROVED INNER STRUCTURE

(75) Inventor: Christopher Jeffrey Hession, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 584 days.

(21) Appl. No.: 11/463,620

(22) Filed: Aug. 10, 2006

(65) Prior Publication Data

US 2007/0045149 A1 Mar. 1, 2007

Related U.S. Application Data

(60) Provisional application No. 60/707,011, filed on Aug. 10, 2005, provisional application No. 60/721,409, filed on Sep. 28, 2005.

(51) Int. Cl.
*B65D 83/04* (2006.01)
*B65D 85/42* (2006.01)

(52) U.S. Cl. ..... 206/538; 206/528; 206/531; 229/125.125

(58) Field of Classification Search ..... 206/528, 206/531, 538, 387.11, 534, 784, 521.1; 229/125.125, 229/913, 120.11, 120.15, 120.8
See application file for complete search history.

(56) References Cited

U.S. PATENT DOCUMENTS

| | | | |
|---|---|---|---|
| 3,137,435 | A | 6/1964 | Meyers |
| 3,215,332 | A | 11/1965 | Bess |
| 3,332,600 | A | 7/1967 | Guernsey |
| 3,381,808 | A | 5/1968 | McGraw, II |
| 3,888,350 | A | 6/1975 | Horvath |
| 3,987,891 | A | 10/1976 | Horvath |
| 4,007,828 | A | 2/1977 | Mayled |
| 4,101,761 | A | 7/1978 | Merryman |
| 4,113,098 | A | 9/1978 | Howard |
| 4,126,224 | A | 11/1978 | Laauwe et al. |
| 4,154,113 | A | 5/1979 | Engeler |
| 4,192,422 | A | 3/1980 | Kotyuk |
| 4,340,141 | A | 7/1982 | Fischer |
| 4,364,488 | A | 12/1982 | Anjou |
| 4,401,210 | A | 8/1983 | Anjou |
| 4,454,704 | A | 6/1984 | Ullman |
| 4,817,819 | A | 4/1989 | Kelly |
| 4,889,236 | A | 12/1989 | Bartell et al. |
| 4,940,016 | A | 7/1990 | Heath |
| 5,115,416 | A | 5/1992 | Gehlbach et al. |
| 5,275,291 | A | 1/1994 | Sledge |

(Continued)

FOREIGN PATENT DOCUMENTS

| | | |
|---|---|---|
| DE | 3440853 | 5/1985 |

(Continued)

*Primary Examiner*—Ehud Gartenberg
*Assistant Examiner*—King M Chu
(74) *Attorney, Agent, or Firm*—MWV Intellectual Property Group

(57) ABSTRACT

A package includes a slide card that is received in an outer sleeve having a false end wall. The false end wall extends between a top wall and a bottom wall to enhance the structural integrity of the outer sleeve. The false end wall provides child resistance in that it prevents a user from manipulating the outer sleeve to inadvertently disengage a locking feature that lockably retains a slide card in the outer sleeve. The false end wall also prevents a user from accessing the slide card through an opening that is created by removing an end wall.

17 Claims, 4 Drawing Sheets

U.S. PATENT DOCUMENTS

| | | | | |
|---|---|---|---|---|
| RE35,445 | E | 2/1997 | Pora | |
| 5,799,675 | A | 9/1998 | Gunderman et al. | |
| 5,954,202 | A | 9/1999 | Mellon | |
| 5,954,204 | A | 9/1999 | Grabowski | |
| 6,047,829 | A | 4/2000 | Johnstone et al. | |
| 6,082,544 | A | 7/2000 | Romick | |
| 6,112,978 | A * | 9/2000 | Barr et al. | 229/120.21 |
| 6,230,893 | B1 | 5/2001 | Karow | |
| 6,349,831 | B1 | 2/2002 | Buss | |
| 6,412,636 | B1 | 7/2002 | Jones et al. | |
| 6,491,211 | B1 | 12/2002 | Evans et al. | |
| 6,752,272 | B2 * | 6/2004 | Jones et al. | 206/534 |
| 7,389,875 | B2 * | 6/2008 | Sandberg et al. | 206/531 |
| 2004/0035740 | A1 | 2/2004 | Paliotta et al. | |
| 2004/0050748 | A1 | 3/2004 | Ehrlund | |
| 2004/0188311 | A1 | 9/2004 | Paliotta et al. | |

FOREIGN PATENT DOCUMENTS

| | | | |
|---|---|---|---|
| DE | 29921100 | U1 | 3/2000 |
| DE | 20105928 | U1 | 6/2001 |
| EP | 1002744 | A1 | 5/2000 |
| EP | 1293436 | B1 | 8/2005 |
| EP | 1652781 | A2 | 5/2006 |
| FR | 2816916 | A1 | 5/2002 |
| GB | 1325802 | A | 8/1973 |
| WO | WO 01/28865 | A1 | 4/2001 |
| WO | WO 03/097331 | A1 | 11/2003 |
| WO | WO 2004/019854 | A2 | 3/2004 |
| WO | WO 2005/051801 | A1 | 6/2005 |
| WO | WO 2006/042181 | A1 | 4/2006 |
| WO | WO 2007/021788 | A1 | 2/2007 |

* cited by examiner

PACKAGING SYSTEM WITH AN IMPROVED INNER STRUCTURE

RELATED APPLICATIONS

This application claims priority to U.S. Application No. 60/707,011, filed Aug. 10, 2005, the entirety of which is incorporated herein by reference. This application also claims priority to U.S. Application No. 60/721,409, filed Sep. 28, 2005, the entirety of which is incorporated herein by reference.

FIELD OF THE INVENTION

The invention relates to a packaging system for packaging and dispensing articles and, more specifically, to a packaging system that includes an outer sleeve with an inner structure that provides additional security to articles that are located on an interior slide card.

BACKGROUND OF THE INVENTION

A known packaging system includes a blister package, such as a slide card, which is received in an outer sleeve. Such a packaging system is a convenient packaging format for certain pharmaceutical applications because the blister package can be repeatedly removed from and returned to the outer sleeve in order to dispense unit doses from the blister package. The blister package is also a useful format because it enables a user to track the consumption of doses according to a prescribed schedule. The outer sleeve functions to provide child resistance to the blister package. Specifically, the blister package can be lockably retained within the outer sleeve by a locking mechanism and released from the outer sleeve by a release mechanism. Further, operating the release mechanism requires a set of actions that are counter-intuitive to a child in order to release the blister package from the outer sleeve.

Child resistance is a feature particularly desired for pharmaceutical packaging and, with regard to certain products, is mandated by the Poison Prevention Packaging Act of 1970. For example, to achieve a desired child resistance (CR) rating of F=1, the number of subject packages that are compromised by children of a specific age may not exceed a pre-set failure rate. This general guideline is designed to ensure that the package has sufficient integrity against tampering by children.

Although many packaging systems include child-resistant locking features, some packaging systems include an outer sleeve that is structurally weak. Such an outer sleeve can be crushed to disengage the locking mechanism of the outer sleeve without properly operating the release mechanism. Thereby the blister package can be inadvertently released from the outer sleeve to gain access to the medication therein. Further, access to the blister package may be achieved should the end wall of the outer sleeve be compromised to provide an opening, for example, by a child who bites through the end wall of the outer sleeve.

In one effort to resolve this problem, an outer sleeve has been developed that includes a false end wall which provides structural support to the outer sleeve. Thereby, the outer sleeve cannot be crushed to release the blister package from the outer sleeve and a potential opening in an end wall of the outer sleeve is obstructed. However, the manufacturing processes that are necessary to form an outer sleeve having a previously developed false end wall from a blank have proven to be cumbersome and inefficient. For example, during construction of that package the blank must be flipped and rotated to form the outer sleeve after having formed the false bottom. Thus, folding such a blank requires multiple folding sequences that are performed by multiple straight line machines, a single sequence performed by specialized machinery, and/or performed by hand. In any case, the time and expense to form an outer sleeve with a false end wall from such a blank is substantially increased.

Accordingly, there remains in the art a need for a packaging system that facilitates easy access to articles by the intended user and that has an improved inner structure so as to be less susceptible to manipulation by an unintended user, such as a child. Further, there is also a need for a packaging system that is easily and efficiently constructed by a machine-friendly automated process.

SUMMARY OF THE INVENTION

The present invention overcomes the deficiencies of the known art and the problems that remain unsolved, by providing a packaging system that includes a slide card which is received in an outer sleeve having an improved false end wall. The improved false end wall is designed to be easily formed in a manufacturing process for forming the outer sleeve. In the exemplary embodiment, the false end wall is defined or struck from an inner panel of a blank that can be folded and secured to form the outer sleeve. Specifically, the blank for forming the outer sleeve can be folded and secured by a straight line machine to form a collapsed tubular structure and a collapsed false end wall such that, as the collapsed tubular structure is erected, the false end wall of the outer sleeve is erected.

The erected tubular structure has two open ends. One of the open ends provides an opening for receiving the slide card, and at the opposite open end an end closure structure is formed that defines an end wall of the outer sleeve. The false end wall is erected adjacent the end wall or otherwise between the end wall and the open end of the outer sleeve such that, if the end wall is compromised or removed to provide an opening, the false end wall prevents the slide card from being pulled through that opening. In certain embodiments, the plane defined by the false end wall is substantially perpendicular to the plane defined by the end wall of the outer sleeve.

In the exemplary embodiments, the packaging system includes elements that provide a locking feature for retaining the slide card within the outer sleeve as well as elements that provide a release mechanism for releasing the slide card from the locking feature. Thereby, the slide card can be repeatedly removed to dispense articles therein to an intended user and reinserted in the outer sleeve to prevent the articles from being dispensed to an unintended user. In the exemplary embodiments, the elements that provide the locking feature include an engaging tab of the slide card and an engaging aperture of the outer sleeve in that the engaging tab is received in the engaging aperture to releasably lock the slide card in the outer sleeve. The elements that provide the release mechanism include a release button of the outer sleeve that can be pressed to disengage the engaging tab from the engaging aperture such that the slide card can be at least partially removed from the outer sleeve. The false end wall enhances the structural integrity of the package such that the outer sleeve cannot be crushed or otherwise manipulated to disengage the engaging tab from the engaging aperture, without first pressing the release button. Accordingly, the false end wall can be disposed adjacent the lock and release mechanism of the outer sleeve.

In the exemplary embodiments, the false end wall extends vertically between top and bottom walls of the outer sleeve. Specifically, the false end wall is struck from an inner panel that forms a composite top wall of the outer sleeve. The elements that form the exemplary false end wall include a false bottom panel and a glue flap, which are defined in the inner panel. Specifically, the false bottom panel and the glue flap are defined in the inner panel by a cut line and two fold lines. The false bottom panel is hingedly connected to the inner panel and to the glue flap. According to an exemplary method, the glue flap is secured to the bottom wall such that the false bottom panel is hingedly connected to the top and bottom walls of the outer sleeve to define the false end wall. Thereby, since the false end wall is hingedly connected to the top and bottom walls of the outer sleeve, the false end wall and the tubular structure of the outer sleeve can be simultaneously erected from a collapsed condition.

In alternative embodiments the slide card may be configured to hold articles on structures other than a slide card, such as a tray as taught in one or more co-pending applications that claim priority to U.S. provisional patent application No. 60/591,677, and incorporated herein by reference. Still other alternative embodiments includes articles attached directly to the slide card, without first being placed in primary packaging.

Regarding the embodiments illustrated or described herein, as well as those covered by the claims, the packaging system may include other locking mechanisms without departing from the scope of the claims. In addition, the exterior panel may be folded to provide the package with a rectangular profile that allows efficient stacking for storage or transport. The package may also be configured to include a variety of shapes and sizes and may or may not be reusable.

Other means for improving the structural integrity of the overall package may be incorporated. Such features may include lamination of the slide card with a polymeric film which improves tear resistance. In addition, the outer sleeve and the slide card may be constructed of a cardboard, plastic, or tear-resistant paperboard material. Dosage or product information, compliance instructions, or any other information may or may not be provided. Further, information may be on any surface of the outer sleeve. Alternatively, information may be provided on an insert that is inserted within an exterior pocket of a panel. That exterior pocket panel may be removably attached to the outer sleeve.

In alternative embodiments, means for a false end wall includes a structure that provides interior support to an outer sleeve, whether formed from an outer sleeve panel and erected substantially perpendicular to an end wall, or whether separately created as a subassembly and inserted in the outer sleeve. Means for a false end wall formed from an outer sleeve panel can be folded and erected to create a variety of configurations including the general shapes of a square, a rectangle, a triangle, or the letters "Z", "C", "V", "I", "J", "L", "T", "O" or "U", and the like. Subassemblies include all inserts in any location and orientation, whether formed of solid or hollow materials such as but not limited to foam, wood, paper, plastic, air bubbles, air pockets, and the like. The means for false end wall can be secured to one of the walls of the tubular structure.

DETAILED DESCRIPTION

Figure 1:
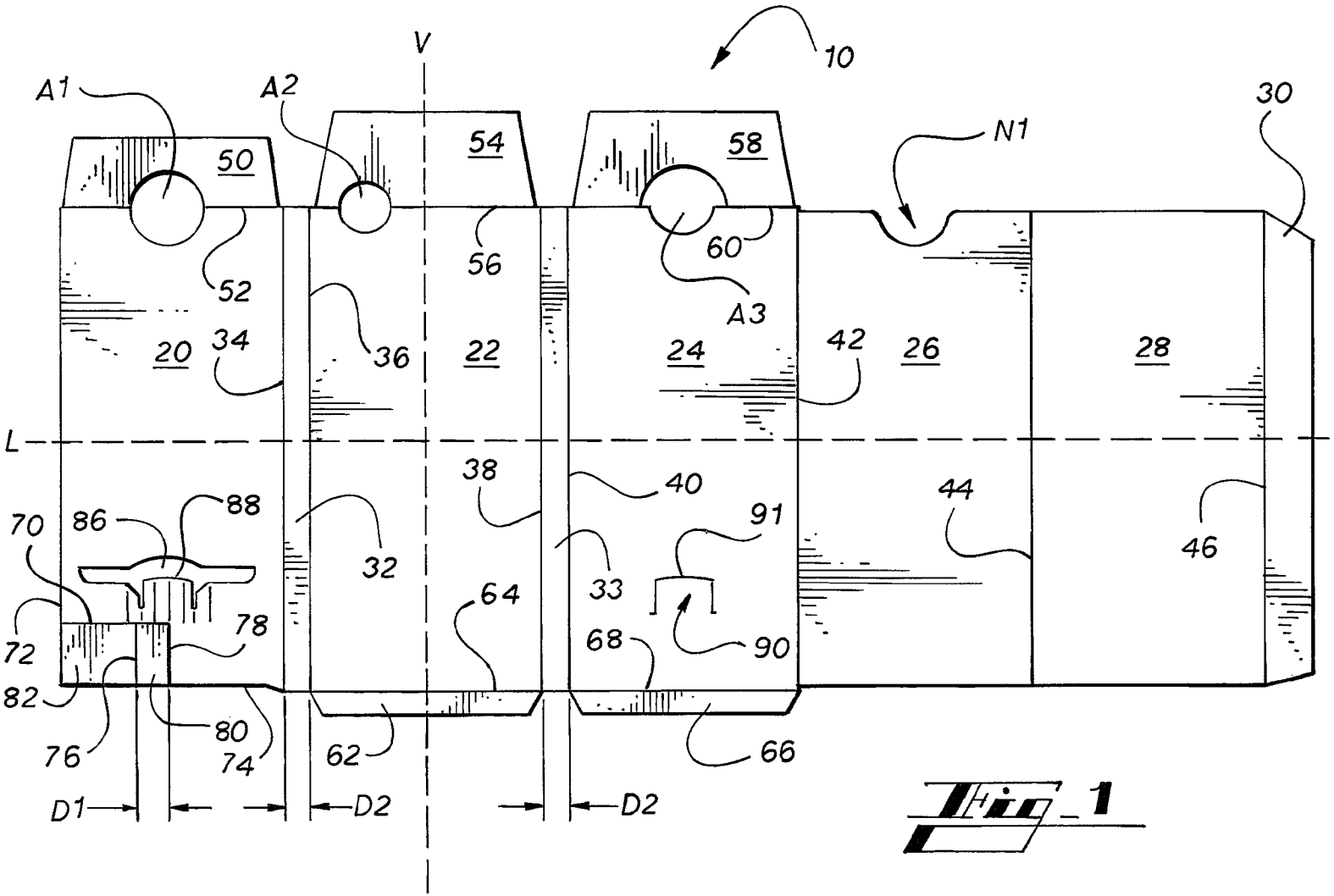
FIG. 1 is a plan view of an exemplary embodiment of a blank for forming an outer sleeve with a false end wall, according to the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings in which like numerals indicate like elements throughout the several views, the drawings illustrate certain of the various aspects of exemplary embodiments of a package that includes an outer sleeve having a false end wall that is easily formed from a blank along with the outer sleeve, according to the present invention. In the embodiments described herein, the false end wall provides structural integrity to a portion of the outer sleeve near a locking mechanism having a release mechanism such that the outer sleeve cannot be manipulated so as to disengage the locking mechanism without using the release mechanism. The outer sleeve also provides a barrier such that the slide card cannot be removed through an opening that is formed when the end wall of the outer sleeve is removed or otherwise compromised.

Referring to FIG. 1, a plan view of an exemplary embodiment of a blank 10 for forming an outer sleeve 12 (shown in FIGS. 2 and 4) is shown. Generally described, the blank 10 is formed from a foldable sheet material such as paperboard, corrugated board, plastic, cardboard, any other flexible and durable material, and the like. The selection of this material may be made according to the packaging needs. For example, a material selected for medicines should be recognized as safe by the Food and Drug Administration. In certain preferred embodiments, the material may be selected from a sheet of bleached sulfate board, a sheet of solid unbleached sulfate board (SUS), clay-coated newsback (CCNB), or any other suitable board material. In other examples, the paperboard may be clay coated on one side (C1S) or both sides (C2S) with a coating such as a fluidized blend of mineral pigments. The mineral pigments may be coating clay, calcium carbonate, or titanium dioxide and may be combined with starch or adhesive. Successive densification and polishing (via calendering) finishes each coated surface to a high degree of smoothness and renders it suitable for printing graphics of superior quality. Text or graphic information may be printed on the outer sleeve 12 or on the surface of the slide card according to any means conventionally known in the art. Similarly, a slide card 110 (shown in FIG. 3) can be formed from foldable sheet material, as described above.

At least a part of one or both sides of the blank 10 may be laminated with a polymer film. In this manner, the outer sleeve 12 is made more resistant to tearing. Optionally, this lamination may not extend over the entire surface of the blank 10 since only tear prone regions of the outer sleeve 12 may require lamination. Suitable laminating materials may be selected from biaxially oriented or cross-laminated polymeric films such as high density polyethylene (HDPE), polyolefins, polyesters, or combinations thereof. In a related embodiment, tear resistance may be provided at stress points, such as the corners and exposed edges of the outer sleeve 12, by applying one or more strips of polymeric film over these areas. In either aspect, polymeric film may be applied by extrusion, adhesive lamination, or by any other suitable means known in the art. Polymeric film is typically applied to the side that is the interior surface of the blank 10. Similar lamination with polymeric film may be used to treat the surface of the slide card 110.

The blank 10 includes a number of primary panels that are substantially rectangular and that are aligned along the longitudinal axis L of the blank 10. For reference, a transverse axis V is provided to illustrate a transverse direction, which is substantially perpendicular to the longitudinal axis L. Certain of the primary panels are folded and secured to form a tubular structure, as described in further detail below. The primary panels are hingedly connected one to the next along transverse fold lines, which are substantially perpendicular to the longitudinal axis L of the blank 10. The primary panels of the blank 10 include an inner panel 20, a bottom panel 22, a top panel 24, a first pocket panel 26, a second pocket panel 28, an end panel 30, and side panels 32, 33. The panels 20, 22 are hingedly connected to opposite edges of the first side panel 32 along fold lines 34, 36. The panels 22, 24 are hingedly connected to opposite edges of the second side panel 33 along fold lines 38, 40. The first pocket panel 26 is hingedly connected to the top panel 24 along fold line 42, the second pocket panel 28 is hingedly connected to the first pocket panel 26 along fold line 44, and the end panel 30 is hingedly connected to the second pocket panel 28 along fold line 46.

The blank 10 further includes a number of extension panels that are hingedly connected to an end edge of certain primary panels along fold lines that are substantially parallel to the longitudinal axis L of the blank 10. An inner extension panel 50 is hingedly connected to the inner panel 20 along a fold line 52, a bottom extension panel 54 is hingedly connected to the bottom panel 22 along a fold line 56, and a top extension panel 58 is hingedly connected to the top panel 24 along a fold line 60. Apertures A1, A2, A3 are disposed in the blank 10 so as to interrupt fold lines 52, 56, 60 and thereby each aperture A1, A2, A3 is partially disposed in a respective primary panel and partially disposed in a respective extension panel. Specifically, aperture A1 is partially disposed in inner panel 20 and partially disposed in inner extension panel 50. Aperture A2 is partially disposed in bottom panel 22 and partially disposed in bottom extension panel 54. Aperture A3 is partially disposed in top panel 24 and partially disposed in top extension panel 58. In addition, the first pocket panel 26 includes a notch N1. When the extension panels are folded relative to the respective primary panels, the apertures define notches which facilitate removing the slide card from the outer sleeve. The apertures are positioned relative to one another to provide child resistance, as described in further detail below.

End wall panels are hingedly connected to an end edge of certain primary panels along fold lines that are substantially parallel to the longitudinal axis L of the blank 10. The end wall panels can be folded and secured as described below to form an end closure structure at an open end of the tubular structure defined by certain primary panels and thereby define an end wall of the outer sleeve 12. A first end wall panel 62 is hingedly connected to the bottom panel 22 along a fold line 64 and a second end wall panel 66 is hingedly connected to the top panel 24 along a fold line 68.

The blank 10 includes elements that define a false end wall 102 (shown in FIG. 2) in the outer sleeve 12 when folded and secured as described below. In the exemplary embodiment, a plurality of panels for forming a false end wall 102 are defined in the inner panel 20 by a cut line 70 and two fold lines 76, 78. Specifically, a false bottom panel 80 is at least partially defined by the fold lines 76, 78 and the cut line 70. In addition, the glue flap 82 is at least partially defined by the fold line 76 and the cut line 70. The cut line 70 extends from a transverse free edge 72 of the inner panel 20 toward the fold line 34 and is orientated substantially parallel to a longitudinal free edge 74 of the inner panel 20. The first fold line 76 and the second fold line 78 extend between the longitudinal free edge 74 and the cut line 70. Specifically, the second fold line 78 extends transversely between the distal end of the cut line 70 and the longitudinal free edge 74. The first fold line 76 is offset from and substantially parallel to the second fold line 78. The fold lines 76, 78 are offset from one another by a distance D1.

The top panel 24 and the inner panel 20 include elements that at least partially define a locking mechanism and a release mechanism for the outer sleeve 12, as described in further detail below. The top panel 24 includes a release button 90 that is defined by a contoured cut line 91 and the inner panel 20 includes an engaging aperture 86 that defines a node 88. The release button 90 and engaging aperture 86 are disposed in their respective panels 24, 20 such that when the top panel 24 overlaps the inner panel 20, as described in further detail below, the release button 90 functionally aligns with the node 88.

It is envisaged that, in any embodiment of the present invention, the carton can be formed from a blank by a series of sequential folding and gluing operations, which can be performed by a straight-line automatic packaging machine so that the carton is not required to be rotated or inverted to complete its construction. It is also envisaged that the series of sequential folding and gluing operations can be manually performed. The folding process is not limited to that described below and can be altered according to particular manufacturing or user requirements. In addition, alternative embodiments may be made from multiple individual blanks, panels, or panel portions, rather than the illustrated single blank, without varying from the scope of the claims.

Turning now to the erection of the blank 10, it will be understood by those skilled in the art that the particular sequences of folds discussed below are neither limiting nor the only sequence of folds possible to erect the outer sleeve 12 from the blank 10. The blank 10 may be initially folded to form a collapsed tubular structure with a collapsed false end wall such that the collapsed tubular structure and collapsed false end wall can be simultaneously erected to form the outer sleeve 12 having a false end wall 102 (shown in FIG. 2). Arranging the outer sleeve 12 in a collapsed condition facilitates shipping or stacking the outer sleeve 12. For purposes of clarity, the side or surface of the blank 10 that is shown in FIG. 1 is designated the outside surface of the blank 10 and the opposite side is designated as the inside surface of the blank 10.

According to a first exemplary method for forming a collapsed tubular structure with a collapsed false end wall, the inner extension panel 50 and the bottom extension panel 54 are folded along respective fold lines 52, 56 such that the inside surface of each of the extension panels 50, 54 is substantially in a face contacting arrangement with the inside surface of the panels 20, 22, respectively. The bottom extension panel 54 can be optionally secured to the bottom panel 22. Adhesive is applied to the inside surface of the glue flap 82 and the inner panel 20 is folded along fold line 34 such that the inside surface of the glue flap 82 is secured to the inside surface of the bottom panel 22. Adhesive is further applied to the outside surface of the inner panel 20 and the blank 10 is folded along fold line 38 such that the inside surface of top panel 24 overlaps and is secured in a face contacting arrangement with the outside surface of the inner panel 20.

According to a second exemplary method for forming a collapsed tubular structure with a collapsed false end wall, the glue flap 82 is folded along the fold line 76 such that the inside surface of the glue flap 82 is substantially in a face contacting arrangement with the inside surface of the false bottom panel 80. Adhesive is applied to the outside surface of the glue flap 82. The inner panel 20 is folded along fold line 34 such that the outside surface of the glue flap 82 is secured to the inside surface of the bottom panel 22. Adhesive is then applied to the outside surface of inner panel 20 and the blank 10 is folded along fold line 38 such that the inside surface of the top panel 24 overlaps and is secured in a face contacting arrangement with the outside surface of the inner panel 20.

According to a third method for forming the collapsed tubular outer sleeve with a collapsed end wall, the false bottom panel 80 is folded along the fold line 78 such that the inside surface of the false bottom panel 80 is substantially in a face contacting arrangement with the inside surface of the inner panel 20. Adhesive is applied to the outside surface of the glue flap 82. The blank 10 is folded along the fold line 36 such that the outside surface of the glue flap 72 is secured to the inside surface of the bottom panel 22. Adhesive is then applied to the outside surface of inner panel 20 and the top panel 24 is folded along fold line 40 such that the inside surface of top panel 24 overlaps and is secured in a face contacting arrangement with the outside surface of the inner panel 20.

Figure 2:
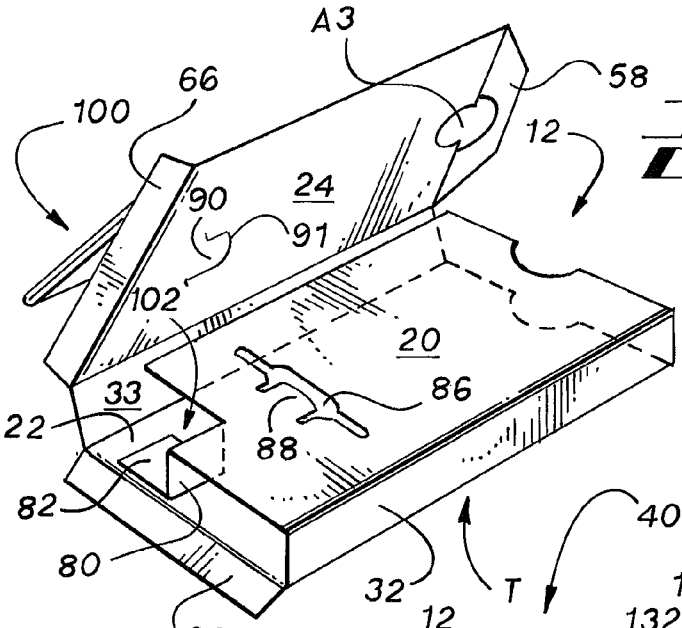
FIG. 2 is a perspective view of an outer sleeve that is partially erected from the blank of FIG. 1.
Figure 4:
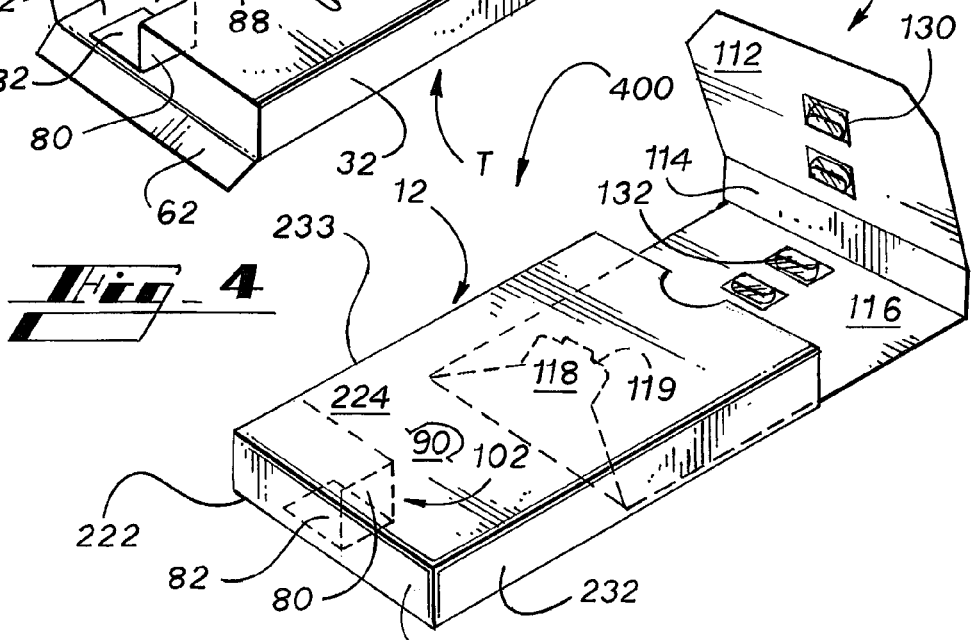
FIG. 4 is a perspective view of an outer sleeve formed from the blank of FIG. 1 that is shown to receive the slide card of FIG. 3 to form an exemplary package, according to the present invention.

A collapsed tubular structure with a collapsed false end wall, which is formed from any of the methods described above, can be erected to form the outer sleeve 12, best shown in FIGS. 2 and 4, by pulling the bottom panel 22 from the inner panel 20 such that the panels 20, 22, 24 are substantially parallel to one another and substantially perpendicular to each of the side panels 32, 33. In addition, a false end wall 102 is erected as the bottom panel 22 is pulled from the inner panel 20 such that the false bottom panel 80 is substantially perpendicular to the panels 20, 22 and substantially parallel to the side panels 32, 33. When arranged as a tubular structure the top panel 24 and the inner panel 20 define a composite top wall 224, the bottom panel 22 defines a bottom wall 222, and the side panels define side walls 232, 233. To complete the folding sequence for the outer sleeve 12, the end panels 76 and 84 are folded and secured to form an end closure structure that defines an end wall 104 of the outer sleeve 12, as shown in FIG. 4.

Referring to FIGS. 1 and 4, the false bottom panel 80, which defines the false end wall 102, is substantially parallel to the side walls 232, 233 in embodiments where the height of the false bottom panel 80, as defined by the distance D1 between the fold lines 76, 78, is substantially equal to the height of the side walls 232, 233, as defined by the distances D2 between the fold lines 34, 36 and between the fold lines 38, 40, respectively. In alternative embodiments, the distance D1 is greater than the distance D2 such that the false bottom panel 80 is disposed at an angle with respect to each of the side walls 232, 233 and with respect to each of the top and bottom walls 224, 222. In certain embodiments, a plane defined by the false end wall 102 is substantially perpendicular to a plane defined by the end wall 104.

It should be noted that the outer sleeve 12 illustrated in FIG. 2 is partially formed in that the top panel 24 is not shown as being secured to the inner panel 20. FIG. 2 is illustrated in this manner to best show certain elements of the outer sleeve 12. It should also be noted that in FIG. 4, for clarity, a pocket 100 formed from the pocket panels 26, 28, as described below, is omitted.

In alternative embodiments, the outer sleeve may include multiple false end walls that extend between walls of the outer sleeve and the false end walls may be arranged in any number of configurations. For example, a number of panels can be defined from the interior panel by a cut line and multiple fold lines. The panels can be folded, and certain of the panels can be optionally secured to the walls of the outer sleeve, to form a configuration where one or more of the panels extend between the walls of the outer sleeve to provide structural integrity to the outer sleeve. It should be understood that the configuration and number of panels used to form the end wall or walls is a design choice that may be at least partially dependent on the process involved in manufacturing such an end wall or walls.

Figure 5:
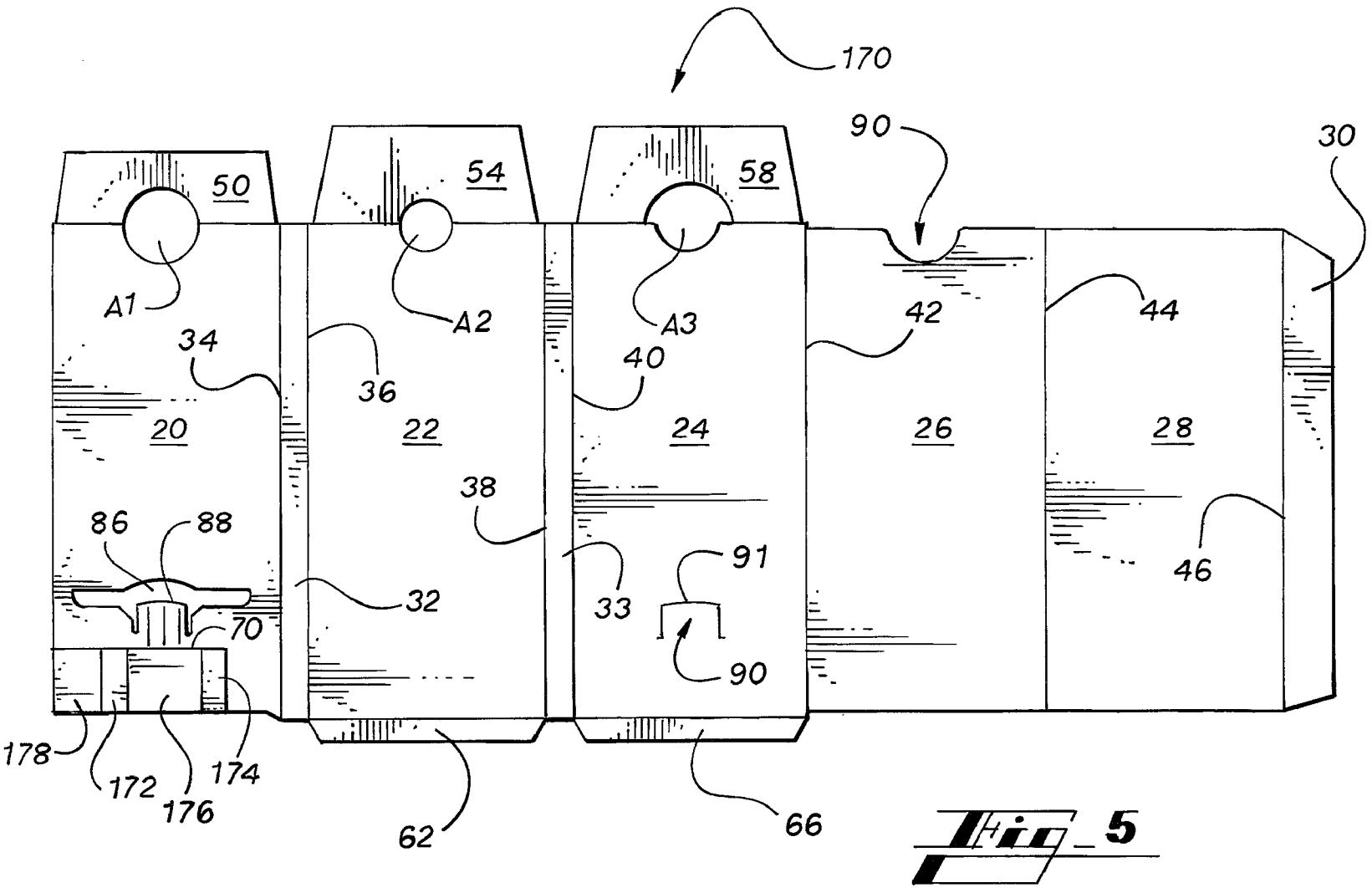
FIG. 5 is a plan view of an alternative embodiment of a blank for forming an outer sleeve with a false end wall, according to the present invention.
Figure 6:
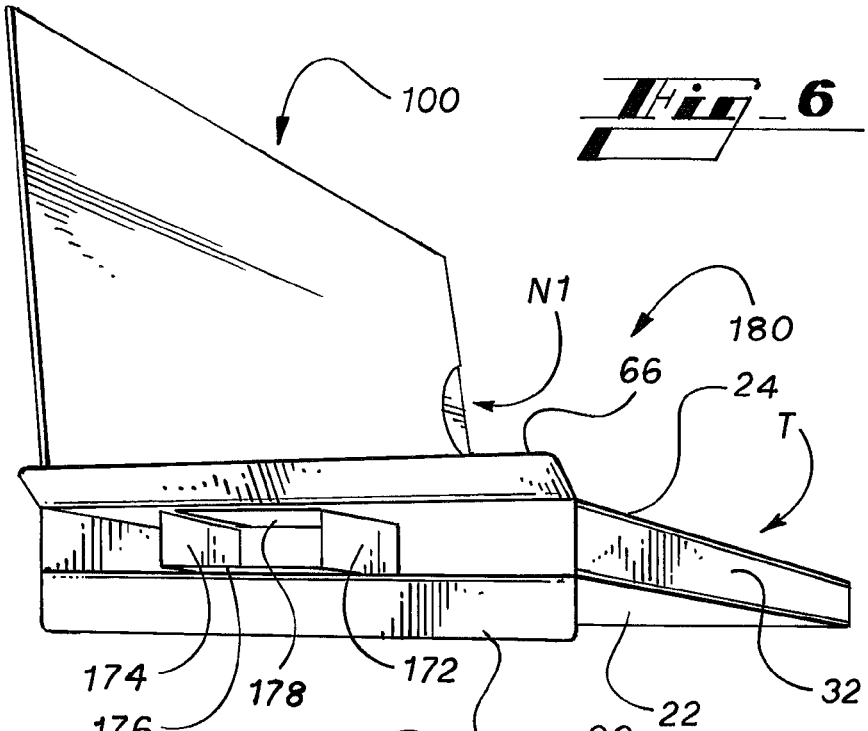
FIG. 6 is a perspective view of a partially erected outer sleeve formed from the blank of FIG. 5.

For example, referring to FIGS. 5 and 6, an alternative embodiment of a blank 170 is shown that can be folded and secured to form an alternative embodiment of an outer sleeve 180 having a false end wall. The blank 170 includes a false end wall configuration that includes a first false bottom panel 172, a second false bottom panel 174, a first glue flap 176, and a second glue flap 178. The illustrated blank 170 may be erected and assembled using a method similar to the methods taught above with respect to the exemplary embodiment. According to an exemplary method, the first glue flap 176 is secured to the bottom panel 22 and the second glue flap 178 is secured to the top panel 24 to create a false bottom panel configuration in the general shape of a rectangle or the letter "O".

In addition, it is contemplated that one or more panels for forming a false end wall can be defined from other panels of the blank 10 including one from the end wall panels 62, 66 or from tabs (not shown) that extend from the sidewalls 32, 33. Further, it is contemplated that panels for forming the false end wall can be hingedly connected to an edge of the blank 10, for example, as described below for the alternative embodiment shown in FIG. 7.

Referring to FIGS. 1, 2, and 6, a pocket 100 can be formed from the pocket panels 26, 28 such that the pocket 100 is hingedly connected to the outer sleeve 12. According to an exemplary method, the end flap 30 is folded along fold line 46 such that the inside surface of the end flap 30 is in a face contacting arrangement with the inside surface of the second pocket panel 28. Adhesive is applied to the outside surface of the end flap 30 and the second pocket panel 28 is folded along the fold line 44 such that the outside surface of the end flap 30 is in a face contacting arrangement with the inside surface of the first pocket panel 26 and is thereby secured to the first pocket panel 26 such that the pocket panels 26, 28 define a pocket 100 with two open ends. The notch N1 at one open end of the pocket 100 facilitates inserting and removing materials from the pocket 100. The opposite end of the pocket 100 can be optionally closed by securing the respective edges of the pocket panels 26, 28 together, for example, with adhesive. The materials that can be inserted into the pocket 100 include product or consumer information provided by the manufacturer or distributor. The top extension panel 58, often referred to as an Ellis flap, is folded outwardly to capture and hold the pocket 100 against the top wall 24.

In the exemplary embodiment, the pocket 100 is integrally formed from part of the blank 10. It will be noted that the pocket 100 may be separately attached to the blank 10, or it may be made detachable, by substituting a tear line or a severance line for the fold line 42. The foldable nature of the pocket 100 allows it to be folded to be in a face contacting arrangement with the top wall 24 of the sleeve 12 and thereby hide the push button 90. The pocket 100 allows the outer sleeve 12 to include a significantly greater amount of printed literature. For example, information can be inserted into the pocket 100 and the outside surface of the pocket 100 can be printed with information. In alternative embodiments, the outer sleeve 12 is manufactured without the pocket 100.

Figure 3:
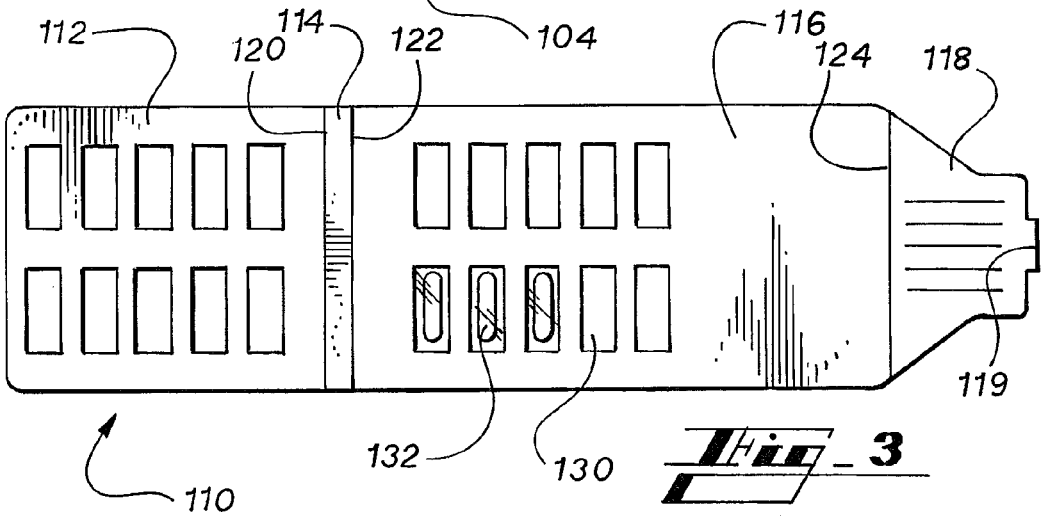
FIG. 3 is a plan view of an exemplary slide card.

Referring now to FIG. 3, a slide card 110 is shown that is suitable for use with the outer sleeve 12. Slide cards with means for securing an item, including those that hold blisters, those with integral trays, those that trays mount to, and those that articles mount directly to, are known or have been developed by the Applicant and are the subject of issued patents and/or co-pending applications. Accordingly, a brief overview of the illustrated slide card 110 will suffice for those skilled in the art.

The illustrated slide card 110 comprises several panels including a cover panel 112, a spine 114, a base panel 116, and an engaging tab 118. The engaging tab 118 includes an engaging edge 119. The cover panel 112, spine 114, base panel 116, and engaging tab 118, are hingedly connected to each other at fold lines 120, 122, and 124, respectively. In the illustrated embodiment the cover panel 112 and base panel 116 include blisters 130 that house articles 132, such as medications. In alternative embodiments, the slide card 110 includes only a base panel 116, a fold line 124, an engaging tab 118, and an engaging edge 119.

FIG. 4 shows an embodiment of a package 400 according to the present invention. To construct the package 400, the following method, which is presented for purposes of teaching and not limitation, is described. Beginning with the folding of the slide card 110, the slide card 110 is folded inwardly along fold lines 120 and 122, such that the cover panel 112 is substantially parallel to the base panel 116 and such that the spine 114 extends between and substantially perpendicular to the panels 112, 116 so as to form an end wall, as described in further detail below. In this configuration the blisters 130 are sandwiched between, and protected by, the cover panel 112 and base panel 116. The engaging tab 118 is then folded inwardly along fold line 124 so that the engaging edge 119 of the engaging tab 118 is proximate to an adjacent edge of the cover panel 112. Accordingly, the engaging tab 118 is disposed at an angle with respect to the base panel 116. In alternative embodiments, the engaging tab 118 is folded outwardly, or away from the cover panel 112, so that the engaging tab 118 disposed at an angle with respect to the base panel 116. In either position, the engaging edge 119 points generally toward the end wall defined by the spine 114.

Referring to FIG. 4, to insert the slide card 110 into the outer sleeve 12, the edge of the slide card 110 that is formed by the adjacent fold line 124 is positioned toward the open end of the outer sleeve 12. The sleeve 12 is oriented such that the engaging edge 119 is matingly aligned with the engaging aperture 86 and node 88 of the inner panel 20. The slide card 110 may then be fully inserted into the outer sleeve 12 between inner panel 20 and bottom panel 22, so that the engaging edge 119 releasably engages the engaging aperture 86. In this configuration, the slide card 110 is fully encased by, and releasably locked in, the outer sleeve 12. When the slide card 112 is fully inserted in the outer sleeve 12, the spine panel 114 closes the open end of the sleeve 12 and thereby forms an end wall closure for the sleeve 12 that is opposite the end wall closure 104. Further, the edge of the slide card 12 that is defined by the fold line 124 is adjacent to or can abut the innermost vertical edge of the false end wall 102.

The engagement of the slide card 110 and outer sleeve 12 is now further discussed in further detail with reference to FIGS. 2 and 4. When folded along fold line 124, the foldability of the slide card 110 causes the engaging tab 118 to resist the fold and inherently spring back toward its unfolded position. This spring resistance holds the engaging edge 119 of the folded engaging tab 118 against the inner panel 20 wherein, when the slide card 110 is fully received in the outer sleeve 12, the engaging edge 119 of the engaging tab 118 can be received in the engaging aperture 86. Specifically, the engaging edge 119 of the tab 118 abuts an edge of the inner panel 20 that is defined by the engaging aperture 86 and that is nearest to the end of the outer sleeve 12 through which the slide card 110 is inserted such that the slide card 110 is releasably locked in the outer sleeve 12. Further, this connection between the edge defined by the engaging aperture 86 and the engaging edge 119 of the engaging tab 118 prevents the slide card 110 from being removed from the outer sleeve 12 unless the release button 90 is depressed. In the exemplary embodiment, the release button 90 and the node 88 cooperate such that, when the release button 90 is depressed, the release button 90 and the node 88 deflect into the outer sleeve 12 thereby pushing against the engaging tab 118 to release the engaging edge 119 from the edge of the engaging aperture 86. The slide card 110 may then be at least partially withdrawn from the outer sleeve 12. In the exemplary embodiment, as the slide card 110 is withdrawn, the spring resistance of the engaging tab 118 holds the engaging edge 119 of the engaging tab 118 against the inner panel 20 such that the engaging edge 119 abuts an edge of, or otherwise the engaging tab 118 interlocks with, the inwardly folded extension panels 54 so as to prevent the slide card 110 from being fully removed from the outer sleeve 12.

The false end wall 102 enhances the structural integrity of the outer sleeve 12 by providing a brace between the top and bottom walls 224, 222 of the outer sleeve 12 and thereby allows the outer sleeve 12 to be more resistant to deformation from squeezing or crushing. As described herein, squeezing or crushing the outer sleeve 12 can inadvertently disengage the locking mechanism of the package, thereby providing inadvertent access to the items therein. As best illustrated in FIG. 2, the false end wall 102 obstructs an opening at one end of the tubular structure T to additionally prevent the articles in the package from being inadvertently accessed.

When the extension panel 50, 54 are folded and secured as described above, the edges of the apertures A1, A2, A3 define notches at the open end of the outer sleeve 12 to facilitate removal of the slide card 110. The apertures A1, A2 are substantially centered with respect to panels 20, 24, respectively, and the aperture A2 is off center with respect to the bottom panel 22. Thus, the notches that are defined by apertures A1, A3 align when the panels 20, 24 overlap to form the outer sleeve 12 and the notch that is defined by the aperture A2 is offset from or is otherwise intentionally misaligned with the notches defined by the apertures A1, A3 with respect to the perpendicular direction between the top and bottom walls 224, 222. The offset relationship between the notches provides an additional child-resistance feature in that, to open the package, the user must grasp the slide card 110 at the positions defined by the offset notches. Grasping the slide card 110 in this manner requires asymmetric placement of the fingers, which is counter-instinctive to children, and thus their ability to grasp and withdraw the slide card 110 from the outer sleeve 12 is greatly reduced. It should be understood that the position of the apertures A1, A2, A3 can be varied such that the notches along the edges of the open end of outer sleeve 12 are offset from one another to produce the same relationship. For example, the location of the notches may be varied depending on the overall dimensions of the package.

Figure 7:
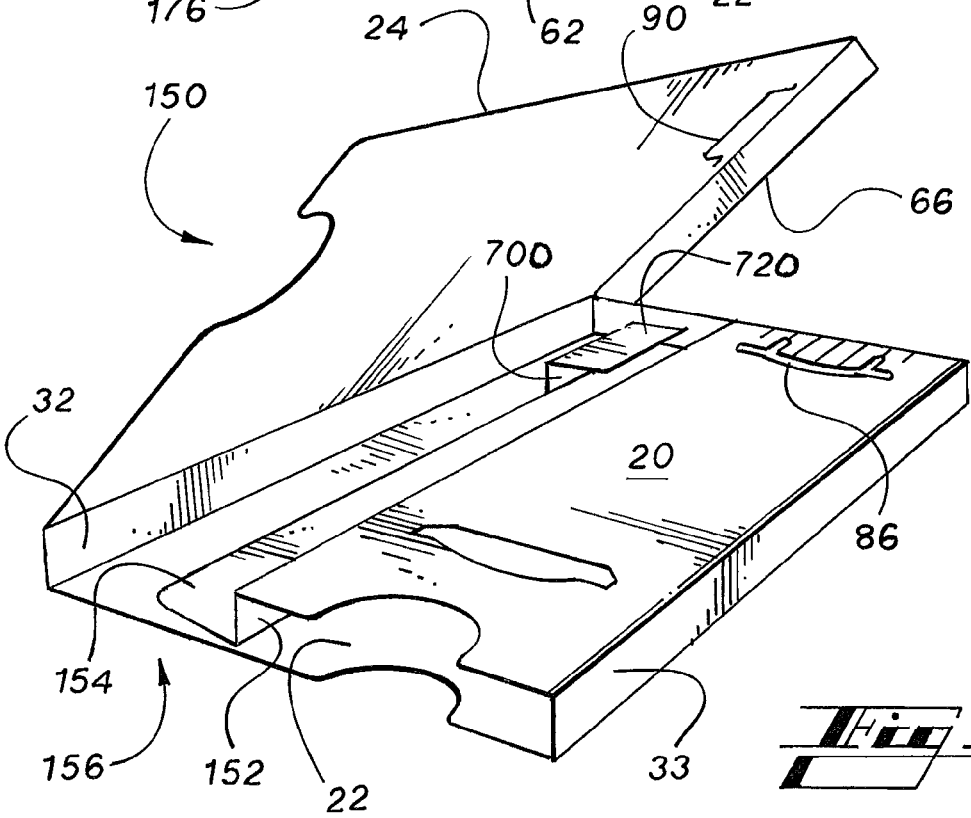
FIG. 7 is a perspective view of an alternative embodiment of an outer sleeve including a false end wall, according to the present invention.

FIG. 7 illustrates an alternative embodiment of an outer sleeve 150 having an accessible void 156 with a false end wall. The elements and features of this embodiment are somewhat similar to that of the exemplary embodiment and, for clarity, the following description will focus on the distinct elements of the alternative embodiment. The alternative embodiment includes an inner partition panel 152 and inner partition glue flap 154. The inner partition panel 152 is hingedly connected to the inner panel 20 and the inner partition glue flap 154 is hingedly connected to the inner partition panel 152. In this embodiment, the false bottom panel 700 is hingedly connected to the inner partition glue flap 154 and the glue flap 720 is hingedly connected to the false bottom panel 700. The elements are arranged such that the present void 156 is defined by the sidewall 32, interior partition panel 152, bottom panel 22, and top panel 24. In the illustrated embodiment, the inside surface of the inner partition glue flap 154 is secured to the inside surface of the bottom panel 22 and the inside surface of the glue flap 720 is secured to the inside surface of the top panel 24 such that the false bottom panel 700 extends between the top panel 24 and the bottom panel 22 in the accessible void 156.

In alternative embodiments, the elements of the embodiment that are illustrated in FIG. 7 are alternatively arranged. The elements that define the locking mechanism and the associate release mechanism are offset from the end wall 104 and the false end wall 102 is disposed in the slide card receiving void, which is defined by the interior partition panel 152, the side panel 33, the bottom panel 22, and the inner panel 20. Accordingly, the outside surface of the inner partition glue flap 154 is secured to the inside surface of the bottom panel 22 and either surface of the glue flap 720 is secured to the inside surface of the inner panel 20 such that the false bottom panel 700 extends between the inner panel 20 and the bottom panel 22.

The accessible void may be used to house medications, mineral supplements, vitamins, and the like that help make the active medication more effective. In addition, the voids may store devices that administer the medications such as an eye-dropper. Further, the void may hold patient information or promotional material in addition to the literature that would otherwise reside in the pocket 100 taught above.

The present invention offers advantages in that it is lightweight, tamper resistant, senior friendly, durable, easy to assemble, economical, and offers protection of each unit dose until it is consumed. Moreover, the invention provides a child resistant, yet user-friendly, unit dose packaging container that may be used to contain and dispense a variety of products. The improved tamper resistant features of the package may be attributed, at least in part, to the presence of the false bottom structural support, the offset notch placement, and the use of partially or fully laminated structural materials in construction of the package sleeve and slide card.

It must be emphasized that the law does not require and it is economically prohibitive to illustrate and teach every possible embodiment of the present claims. Hence, the above-described embodiments are merely exemplary illustrations of implementations set forth for a clear understanding of the principles of the invention. Many variations and modifications may be made to the above-described embodiments without departing from the scope of the claims. All such modifications, combinations, and variations are included herein by the scope of this disclosure and the following claims.

What is claimed is:

1. An outer sleeve, comprising:

a tubular structure including a first composite wall comprising inner and outer panels disposed in a face contacting arrangement, said inner panel includes an engaging aperture for releasably engaging a slide card within said outer sleeve, said engaging aperature being disposed proximate a free end edge of said inner panel, said free end edge partially defining on of opposed open ends of said tubular structure; and at least on false end wall hingedly connected to said inner panel;

wherein said at least one false end wall is formed of material taken from said inner panel such that a corner cutout is defined in an area of said inner panel between said engaging aperture and said free end edge, wherein said at least one false end wall is defined by at least one cut line and at least two fold lines, one of said at least two fold lines extending from said free end edge of said inner panel toward said engaging aperture.

2. The outer sleeve of claim 1, wherein said tubular structure further includes:

a second wall disposed in an opposed position with respect to said composite first wall, wherein said at least one false end wall comprises a false bottom panel between said composite first wall and said second wall, and said false bottom panel is disposed substantially parallel to a tubular axis of said tubular structure.

3. The outer sleeve of claim 1, wherein said composite first wall includes a lock and release mechanism for releasably locking a slide card within said outer sleeve, said lock and release mechanism including said engaging aperture and a deflectable element to be pressed to disengage a slide card from said engaging aperture, said deflectable element being disposed between said engaging aperture and said free end edge of said inner panel, and said at least one false end wall defined by a fold line extending from said free end edge toward said deflectable element.

4. An outer sleeve comprising:

a tubular structure including a substantially planar first composite wall comprising inner and outer panels disposed in a face contacting arrangement, said inner panel includes an engaging aperture configured to releasably engage a slide card within said outer sleeve, said engaging aperture being disposed proximate a free end edge of said inner panel; and at least one false end wall hingedly connected to said inner panel along a fold line extending from said free end edge of said inner panel toward said engaging aperture; wherein said at least one false end wall is formed of material taken from said inner panel such that a corner cutout is defined in an area of said inner panel between said engaging aperture and said free end edge, wherein said at least one false end wall is defined by at least one cut line and at least two fold lines, one of said at least two fold lines extending from said free end edge of said inner panel toward said engaging aperture.

5. The outer sleeve of claim 4, wherein said at least one false end wall comprises a false bottom panel hingedly connected to said inner panel along said fold line, said false bottom panel being disposed substantially perpendicularly to said free end edge of said inner panel such that a slide card when within said tubular structure may be brought into abutment with an innermost edge of said false bottom panel.

6. The outer sleeve of claim 5, wherein said tubular structure further includes a second wall positioned opposed to said first composite wall, said false bottom panel extending between said first composite wall and said second wall such that said false bottom panel is disposed parallel to a tubular axis of said tubular structure.

7. The outer sleeve of claim 4, wherein said inner panel further includes a deflectable element to be pressed to disengage a slide card from said engaging aperture, said deflectable element being disposed between said engaging aperture and said free end edge of said inner panel, and said fold line extends from said free end edge toward said deflectable element such that said fold line is disposed substantially parallel to a tubular axis of said tubular structure.

8. An outer a tubular structure including a first composite wall comprising inner and outer panels disposed in a face contacting arrangement, said inner panel includes an engaging aperture configured to releasably engage a slide card within said outer sleeve, said engaging aperture being disposed proximate a free end edge of said inner panel; and at least one false end wall hingedly connected to said inner panel along a fold lone extending from said free end edge of said inner panel toward said engaging aperture, wherein said inner panel further includes a deflectable element to be pressed to disengage a slide card from said engaging aperture, said deflectable element being disposed between said engaging aperture and said free end edge of said inner panel, and said fold line extends from said free end edge toward said deflectable element, and wherein said tubular structure defines a transverse axis extending between opposed ends of said tubular structure, and said fold line and said deflectable element are disposed along a notional line parallel to said transverse axis.

9. A package or holding an item, comprising:

an outer sleeve including a tubular structure having a first composite wall and a rear end wall closing one of opposed ends of said tubular structure, said first composite wall comprising inner and out panels disposed in a face contacting arrangement, said inner panel including a free end edge disposed alongside said rear end wall and an engaging aperture disposed proximate said free end edge;

a slide card received within said outer sleeve for sliding movement toward and away from said rear end wall, said slide card being configured to releasably engage said engaging aperture when fully received within said outer sleeve; and at least one false end wall hingedly connected to said inner panel along a first fold line extending from said free end edge of said inner panel toward said engaging aperture, and wherein said false end wall comprising a false bottom panel hingedly connected to said inner panel along said first fold line, said first fold line extending from said free end edge toward a rear end edge of said slide card.

10. The package of claim 9, wherein said false end wall structure is formed of material taken from said inner panel such that a corner cutout is defined in an area of said inner panel between said engaging aperture and said free end edge.

11. The package of claim 9, wherein said false bottom panel is disposed substantially perpendicularly to said free end edge of said inner panel such that an innermost edge of said false bottom panel may be brought into abutment on said rear end edge of said slide card to prevent said slide card from being accessed through said one of said opposed ends of said tubular structure.

12. The package of claim 11, wherein said rear end edge of said slide card is disposed transversely of said false bottom panel.

13. The package of claim 9, wherein said slide card comprises a base panel and an engaging tab for releasably engaging said engaging aperture, said engaging tab being hingedly connected to said base panel along a second fold line, said engaging tab being folded about said second fold line with respect to said base panel such that said second fold line defines said rear end edge of said slide card.

14. The package of claim 9, wherein said inner panel further includes a deflectable element to be pressed to disengage said slide card from said engaging aperture, said deflectable element being disposed between said engaging aperture and said free end edge of said inner panel, and said fold line extends from said free end edge toward said deflectable element.

15. The package of claim 14, wherein said tubular structure defines a transverse axis extending between said opposed ends, and said first fold line and said deflectable element are disposed along a notional line parallel to said transverse axis.

16. The outer sleeve of claim 6, wherein said false bottom panel extends from said fold line to an outer edge disposed along a plane of said second wall, and the distance between said fold line and said outer edge is substantially equal to the distance between said first composite wall and said second wall.

17. The outer sleeve of claim 6, wherein said false bottom panel extends from said fold line to an outer edge disposed along a plane of said second wall, and the distance between said fold line and said outer edge is greater than the distance between said first composite wall and said second wall.

* * * * *